US011607685B2

(12) United States Patent
Choi et al.

(10) Patent No.: US 11,607,685 B2
(45) Date of Patent: Mar. 21, 2023

(54) MICROFLUIDIC ANALYSIS CHIP HAVING NEGATIVE PRESSURE GENERATION PART AND METHOD FOR USING SAME

(71) Applicant: BBB Inc., Seongnam-si (KR)

(72) Inventors: Jaekyu Choi, Seoul (KR); Hyundoo Hwang, Bundang-gu (KR); Dongsik Han, Seoul (KR)

(73) Assignee: BBB Inc., Seongnam-si (KR)

( * ) Notice: Subject to any disclaimer, the term of this patent is extended or adjusted under 35 U.S.C. 154(b) by 351 days.

(21) Appl. No.: 16/764,606

(22) PCT Filed: Dec. 22, 2017

(86) PCT No.: PCT/KR2017/015348
§ 371 (c)(1),
(2) Date: May 15, 2020

(87) PCT Pub. No.: WO2019/098453
PCT Pub. Date: May 23, 2019

(65) Prior Publication Data

US 2020/0391208 A1 Dec. 17, 2020

(30) Foreign Application Priority Data

Nov. 16, 2017 (KR) ..... 10-2017-0152742

(51) Int. Cl.
*B01L 3/00* (2006.01)

(52) U.S. Cl.
CPC ..... *B01L 3/502715* (2013.01); *B01L 3/50273* (2013.01); *B01L 2200/027* (2013.01);
(Continued)

(58) Field of Classification Search
CPC ..... B01L 3/502715; B01L 3/50273; B01L 2200/027; B01L 2200/10; B01L 2300/042;
(Continued)

(56) References Cited

U.S. PATENT DOCUMENTS

2010/0167384 A1* 7/2010 Clemmens ..... C12M 23/16 422/63
2015/0136604 A1* 5/2015 Nielsen ..... B01F 33/452 204/453

FOREIGN PATENT DOCUMENTS

JP 2014-115246 A 6/2014
KR 10-2011-0120735 A 11/2011
(Continued)

OTHER PUBLICATIONS

KR20110120735(A) English Machine Translation of Abstract, Description and Claims, obtained from https://worldwide.espacenet.com/on Jun. 29, 2022. (Year: 2022).*
(Continued)

*Primary Examiner* — Christine T Mui
(74) *Attorney, Agent, or Firm* — Studebaker & Brackett PC

(57) ABSTRACT

The present specification discloses a microfluidic analysis chip capable of adjusting movement of a specimen or a reagent by a negative pressure generation unit. A microfluidic analysis chip according to the present specification may comprise: a microtube for a main channel, which provides a space in which a specimen input through a specimen inlet formed at one end thereof reacts with a regent while the specimen moves to the other end thereof; a chip housing surrounding the microtube for the main channel; and a negative pressure generation unit which is positioned in the
(Continued)

chip housing and connected to the microtube, so as to affect an internal pressure of the microtube for the main channel.

9 Claims, 6 Drawing Sheets

(52) U.S. Cl.
CPC ..... *B01L 2200/10* (2013.01); *B01L 2300/042* (2013.01); *B01L 2300/0816* (2013.01); *B01L 2300/123* (2013.01); *B01L 2400/0403* (2013.01); *B01L 2400/0487* (2013.01)

(58) Field of Classification Search
CPC ..... B01L 2300/0816; B01L 2300/123; B01L 2400/0403; B01L 2400/0487
USPC ..... 422/502, 500
See application file for complete search history.

(56) References Cited

FOREIGN PATENT DOCUMENTS

| | | | |
|---|---|---|---|
| KR | 10-2014-0042968 | A | 4/2014 |
| KR | 10-2015-0135613 | A | 12/2015 |
| KR | 10-2016-0038987 | A | 4/2016 |

OTHER PUBLICATIONS

Korean Office Action for 10-2017-0152742 dated Nov. 26, 2018.
International Search Report for PCT/KR2017/015348 dated, Jul. 2, 2018 (PCT/ISA/210).

* cited by examiner

MICROFLUIDIC ANALYSIS CHIP HAVING NEGATIVE PRESSURE GENERATION PART AND METHOD FOR USING SAME

TECHNICAL FIELD

The present invention relates to a microfluidic analysis chip and a method using the same, and more specifically, to a microfluidic analysis chip and a method using the same, which can adjust movement of a sample through a negative pressure generation unit.

BACKGROUND ART

A biochip refers to a chip integrating biomolecules such as DNA and protein on a small substrate made of a material such as glass, silicon, nylon or the like. At this point, when DNA molecules are integrated, it is referred to as a DNA chip, and when protein molecules are integrated, it is referred to as a protein chip. In addition, biochips may be largely divided into microarray chips and microfluidics chips.

The microarray chip refers to a biochip capable of attaching thousands or tens of thousands of DNA or protein molecules to be arranged at regular intervals and analyzing the binding pattern by processing an analysis target material. In addition, the microfluidics chip is a biochip capable of analyzing a pattern of reacting to various biomolecules or sensors integrated in a chip while flowing a small amount of analysis target material, and it is also called as a lab-on-a-chip, which is a cutting-edge technique that combines sensor techniques with the functions of pumps, valves, reactors, extractors, separation systems and the like, which are essential for sample preprocessing of an automatic analysis device used in analysis of biochemicals.

Describing the lab-on-a-chip in more detail, the lab-on-a-chip is a micro analysis device manufactured to perform the process of sample injection, pre-processing, chemical reaction, separation and analysis and the like, which is carried out by the laboratory unit to analyze chemical and biochemical substances, within a chip of a few $cm^2$.

The lab-on-a-chip technique combines a micro flow control technique, which accurately transfers, distributes and mixes samples of an amount from several pico-liters (pl) to tens of micro-liters (μl), with a MEMS micro-processing technique, and it is a core technique of a micro total analysis system.

The lab-on-a-chip, which uses an extremely small amount of samples and quickly and easily analyzes chemical components, is frequently used to select useful new drugs among a large number of new drug candidate materials in a speedy way, and several kinds of lab-on-a-chips are under research and development recently for the purpose of detecting environmental pollutants and diagnosing diseases and so on.

Unlike the microarray chip such as a DNA chip or a protein chip, the lab-on-a-chip still stays in the research and development stage globally, and commercialization is limited and carried out on a small scale, and in the case of lab-on-a-chips commercialized currently, the network of micro-channels is simple, and the reaction process is also implemented in an uncomplicated stage.

DISCLOSURE OF INVENTION

Technical Problem

An object of the present specification is to provide a microfluidic analysis chip capable of adjusting movement of a sample or a reagent through a negative pressure generation unit.

The present specification is not limited to the above-mentioned problems, and other problems that are not mentioned will be clearly understood by those skilled in the art from the following description.

Technical Solution

A microfluidic analysis chip according to the present specification for accomplishing the above object may include: a main channel microtube for providing a space in which a sample injected from a sample inlet hole formed at one end reacts to a reagent while moving toward the other end; a chip housing enclosing the main channel microtube; and a negative pressure generation unit located inside the chip housing and connected to affect internal pressure of the main channel microtube.

According to an embodiment of the present specification, the negative pressure generation unit may include: a pressed unit located on any one side among the top surface and the bottom surface of the main channel microtube, and pressed toward the inner space of the main channel microtube by an external force; and a pushed unit located on the other one side among the top surface and the bottom surface of the main channel microtube, and irreversibly shape-transformed together toward the outside of the main channel microtube by the external force.

Meanwhile, the pressed unit may be made of a material that stores the external force as elastic energy when the pressed unit is pressed toward the inside of the main channel microtube by the external force.

The microfluidic analysis chip according to the present specification may further include: a main exhaust hole formed on any one side of the main channel microtube to move internal air of the main channel microtube and external air of the chip housing to each other; and a main exhaust stopper for opening the main exhaust hole when the negative pressure generation unit moves in a direction increasing the internal pressure of the main channel microtube, and closing the main exhaust hole when the negative pressure generation unit moves in a direction decreasing the internal pressure of the main channel microtube.

In this case, the negative pressure generation unit may have a bellows structure or an injector structure.

The microfluidic analysis chip according to the present specification may further include a sealing film formed between the sample inlet hole and the main channel microtube. In this case, the microfluidic analysis chip may further include a fine needle for piercing the sealing film by external pressure. In addition, the fine needle may seal the sample inlet hole by external pressure.

A microfluidic analysis chip according to the present specification for accomplishing the above object may include: a main channel microtube for providing a space in which a sample injected from a sample inlet hole formed at one end reacts to a reagent while moving toward the other end; a chip housing enclosing the main channel microtube; at least one or more subchannel microtubes, one end of which is connected to a side surface of the main channel microtube, into which a reagent is injected; a negative pressure generation unit located inside the chip housing and connected to affect internal pressure of the main channel microtube; a sample inlet stopper for opening and closing the sample inlet hole; a sub-exhaust hole formed at one end of the subchannel microtube to move internal air of the subchannel microtube and external air of the chip housing to each other; and a sub-exhaust stopper for opening and closing the sub-exhaust hole. In addition, the negative pressure generation unit may have a bellows structure.

A method of using a microfluidic analysis chip having a negative pressure generation unit according to the present specification for accomplishing the above object may include the steps of: (a) injecting a sample into the sample inlet hole; (b) generating negative pressure inside the main channel microtube by handling the negative pressure generation unit.

According to an embodiment of the present specification, the negative pressure generation unit may have a pushed unit and a pressed unit of an elastic material, and step (b) may be a step of pressing a pressure adjustment unit toward the inside of the main channel microtube, and pushing the pushed unit toward the outside of the main channel microtube together, by applying a force to the pressed unit.

According to another embodiment of the present specification, the negative pressure generation unit may have a pressed unit and a pushed unit, and step (b) may be a step of pressing the pressed unit toward the inside of the main channel microtube, and pushing the pushed unit toward the outside of the main channel microtube together, by applying a force to the pressed unit, and the method of using a microfluidic analysis chip may further include a step of (c) restoring the shape in a direction of decreasing the internal pressure of the main channel microtube by contacting the pressed unit.

A method of using a microfluidic analysis chip having a sealing film according to the present specification for accomplishing the above object may include the steps of: (a) injecting a sample into the sample inlet hole; (b) piercing the sealing film; and (c) generating negative pressure inside the main channel microtube by handling the negative pressure generation unit.

According to an embodiment of the present specification, the microfluidic analysis chip may further include a fine needle, and step (b) may be a step of piercing the sealing film by applying a force to the fine needle.

A method of using a microfluidic analysis chip having a sample inlet stopper, a main exhaust stopper, a sub-exhaust stopper, and a negative pressure generation unit according to the present specification for accomplishing the above object may include the steps of: (a) injecting a sample into the sample inlet hole; (b) selectively opening and closing the sample inlet stopper, the main exhaust stopper or the sub-exhaust stopper; and (c) moving a sample or a reagent by handling the negative pressure generation unit.

Other specific matters of the present invention are included in the detailed description and the drawings.

Advantageous Effects

The microfluidic analysis chip according to the present specification may adjust movement of a sample or a reagent through a negative pressure adjustment unit, and may control selective movement and a sequence of movement as needed.

The effects of the present invention are not limited to the effects mentioned above, and other effects not mentioned will be clearly understood by those skilled in the art from the following description.

BEST MODE FOR CARRYING OUT THE INVENTION

Figure 1:
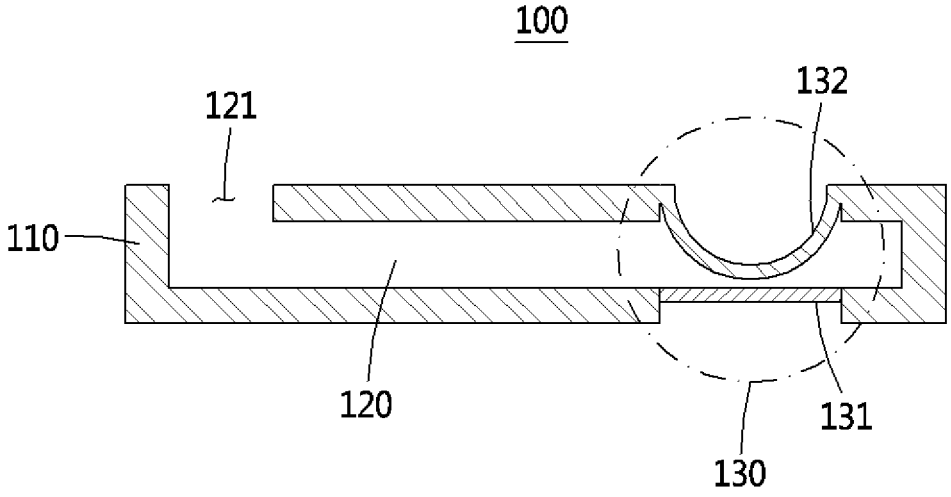
FIG. 1 is a cross-sectional view showing a microfluidic analysis chip according to an embodiment of the present specification.

Advantages and features of the present specification disclosed in the present specification and methods for achieving them will be apparent with reference to the embodiments described below in detail together with the accompanying drawings. However, the present specification is not limited to the embodiments disclosed below, but can be implemented in various forms different from each other, and these embodiments are provided only to make the disclosure of the present specification complete and to completely convey the scope of the invention to those skilled in the art to which the present specification belongs (hereinafter, 'those skilled in the art'), and the scope of the present specification is defined only by the scope of the claims.

The terms used in the present specification are for describing the embodiments and not intended to limit the scope of the present specification. In the present specification, a singular form also includes a plural form unless otherwise specified in the phrase. "Comprises" and/or "comprising" used in the present specification does not exclude presence or addition of one or more other components than the mentioned components. Throughout the specification, like reference numerals refer to like components, and "and/or" includes each of the mentioned components and all combinations of one or more of the components. Although "first", "second" and the like are used to describe various components, it goes without saying that these components are not limited by these terms. These terms are used only to distinguish one component from the other components. Therefore, it goes without saying that a first component mentioned below may be a second component within the spirit of the present invention.

Unless otherwise defined, all terms (including technical and scientific terms) used in the present specification may be used in a sense that can be commonly understood by those skilled in the art to which the present specification belongs. In addition, the terms defined in a generally used dictionary are not ideally or excessively interpreted unless explicitly and specially defined.

The spatially relative terms such as "below", "beneath", "lower", "above", "upper" and the like are, as shown in the drawings, may be used to easily describe the correlation between a component and other components. The spatially relative terms should be understood as terms including different directions of components when the components are used or in operation, in addition to the directions shown in the drawings. For example, when a component shown in the drawings is turned over, the component described as "below" or "beneath" another component will be placed "above" another component. Accordingly, an exemplary term "below" may include both the below and above directions. A component may also be oriented in a different direction, so that the spatially relative terms may be interpreted according to the orientation. Hereinafter, embodiments of the present invention will be described in detail with reference to the accompanying drawings.

FIG. 1 is a cross-sectional view showing a microfluidic analysis chip according to an embodiment of the present specification.

Referring to FIG. 1, a microfluidic analysis chip 100 according to an embodiment of the present specification may include a chip housing 110, a main channel microtube 120, and a negative pressure generation unit 130.

The chip housing 110 encloses the main channel microtube 120. The chip housing 110 may be made of a polymer material such as plastic. The chip housing 110 may be manufactured by separately manufacturing and combining a chip top plate and a chip bottom plate, or may be manufactured in a single process such as a plastic injection method.

The main channel microtube 120 provides a space in which a sample injected from a sample inlet hole 121 formed at one end reacts to a reagent while moving toward the other end. The main channel microtube 120 performs a function of a passage of the sample and provides a space to react to the reagent, and a reaction chamber, which is a space in which the sample and the reagent react as the diameter is relatively large compared to other spaces in the main channel microtube, may be formed.

The negative pressure generation unit 130 may be located inside the chip housing 110 and connected to affect the internal pressure of the main channel microtube 120.

According to an embodiment of the present specification, the negative pressure generation unit 130 may include a pressed unit 131 and a pushed unit 132.

The pressed unit 131 is located on any one side among the top surface and the bottom surface of the main channel microtube 120, and may be pressed toward the inner space of the main channel microtube 120 by an external force. In FIG. 1, the pressed unit 131 is shown to be exposed to the bottom surface of the chip housing 110 through the bottom surface of the main channel microtube 120.

The pushed unit 132 is located on the other one side among the top surface and the bottom surface of the main channel microtube 120, and may be irreversibly shape-transformed together toward the outside of the main channel microtube 120 by the external force. In FIG. 1, the pushed unit 132 is shown to be exposed to the top surface of the chip housing 110 through the top surface of the main channel microtube 120. According to embodiments, the pushed unit 132 may be irreversibly shape-transformed in a moment toward the outside of the microtube to be symmetrical in a direction opposite to the pushing point when a pushed-critical point is crossed.

Figure 2:
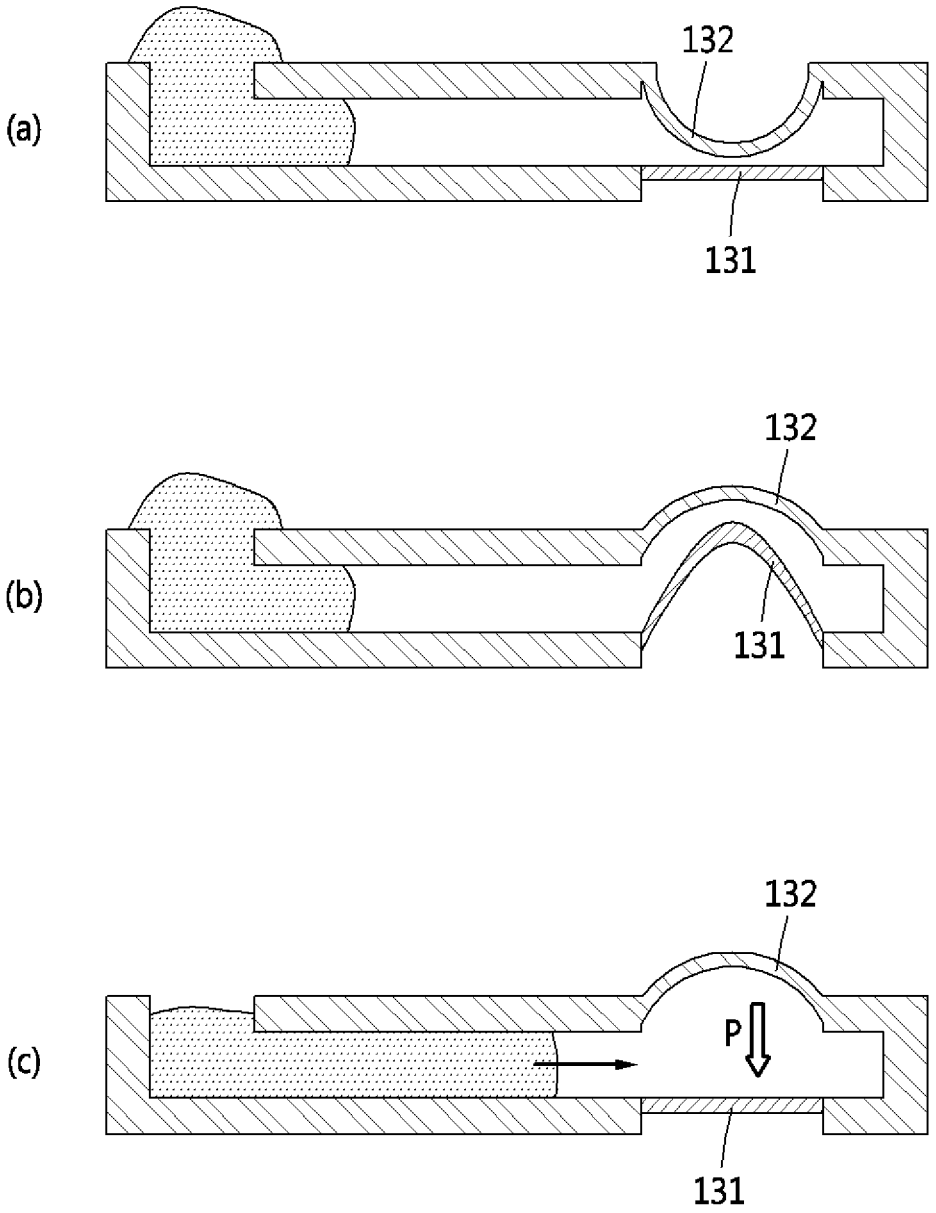
FIG. 2 is reference views showing a method of using a microfluidic analysis chip according to an embodiment of the present specification.

FIG. 2 is reference views showing a method of using a microfluidic analysis chip according to an embodiment of the present specification.

Referring to (a) of FIG. 2, first, a sample is injected into the sample inlet hole. Next, as shown in (b) of FIG. 2, a force is applied to the pressed unit 131 to press the pressed unit 131 toward the inside of the main channel microtube 120. At this point, the pushed unit 132 is pushed together toward the outside of the main channel microtube 120 by the external force. Since the shapes of the pressed unit 131 and the pushed unit 132 are transformed together by the external force, the internal pressure of the main channel microtube 120 is almost unchanged. Depending on embodiments, at the step of pushing the pushed unit 132, the pushed unit 132 may be irreversibly shape-transformed in a moment toward the outside of the microtube to be symmetrical in a direction opposite to the pushing point when a pushed-critical point is crossed. In addition, as shown in (c) of FIG. 2, the shape is restored in a direction of decreasing the internal pressure of the main channel microtube 120 by contacting the pressed unit 131. When the shape of the pressed unit 131 is restored, the shape of the pushed unit 132 is not restored since the shape of the pushed unit 132 is irreversibly transformed. Accordingly, a negative pressure is generated in the internal pressure of the main channel microtube 120, and the sample is moved.

In the pressed unit 131, a pull handle may be formed at the center on the surface of the pressed unit 131 to restore the shape of the pressed unit 131.

Meanwhile, the pressed unit 131 may be made of a material that stores the external force as elastic energy when the pressed unit 131 is pressed toward the inside of the main channel microtube 120 by the external force.

In this case, the method of using the microfluidic analysis chip 100 may be slightly different from the method of using the microfluidic analysis chip 100 described above. The processes of (a) and (b) of FIG. 2 are the same. Since the shape is restored by itself by the elastic force of the pressed unit 131 thereafter, it does not need to intentionally restore the shape of the pressed unit 131 as shown in the process of (c) of FIG. 2. Accordingly, the method of using a microfluidic analysis chip, in which the pressed unit 131 is made of an elastic material, may include the steps of: (a) injecting a sample into the sample inlet hole; and (b) pressing a pressure adjustment unit toward the inside of the main channel microtube, and pushing the pushed unit toward the outside of the main channel microtube together, by applying a force to the pressed unit.

Figure 3:
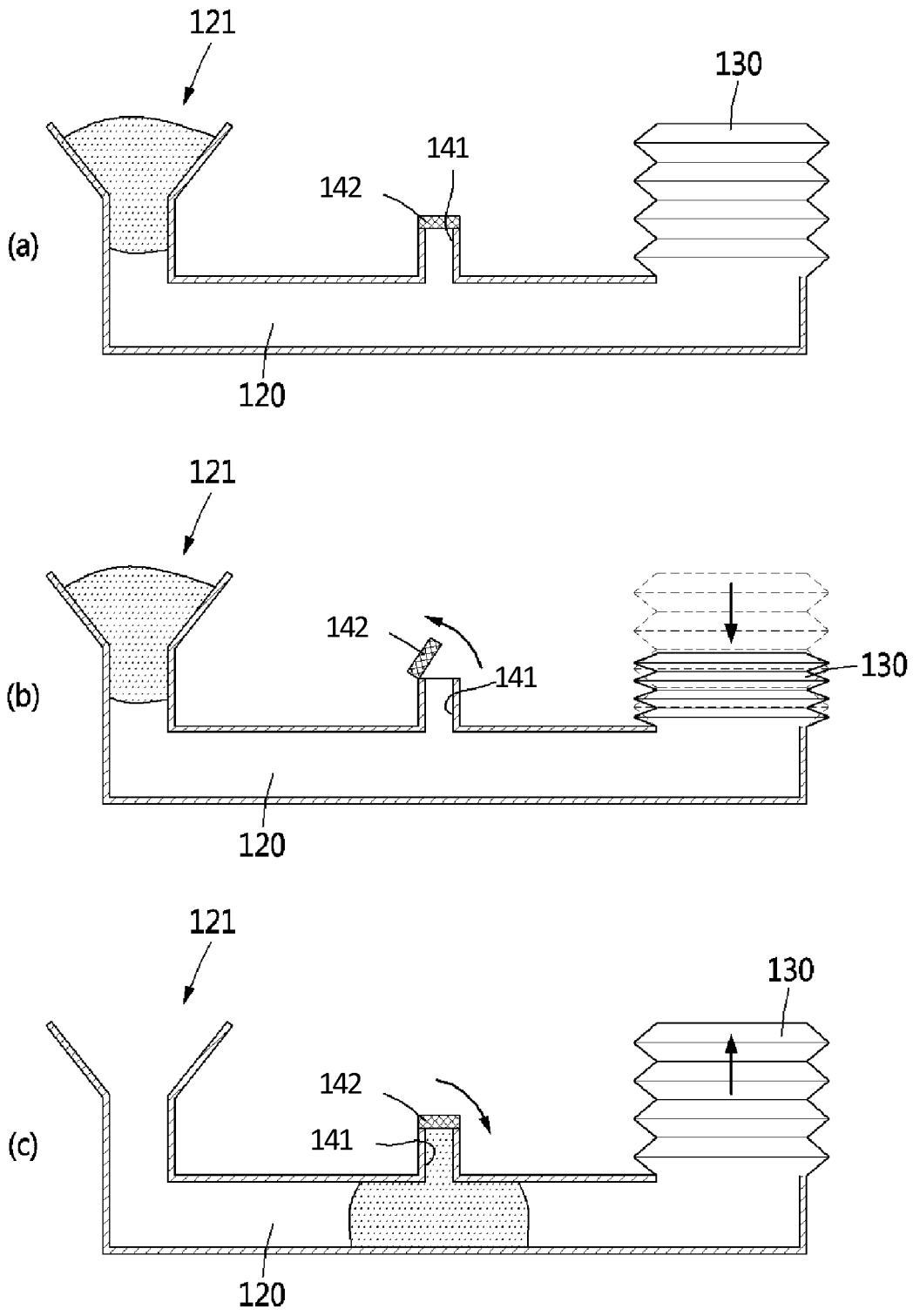
FIG. 3 is configuration views showing a microfluidic analysis chip according to another embodiment of the present specification.

FIG. 3 is configuration views showing a microfluidic analysis chip according to another embodiment of the present specification.

Referring to FIG. 3, the microfluidic analysis chip 100 according to another embodiment of the present specification may include a chip housing 110, a main channel microtube 120, a negative pressure generation unit 130, a main exhaust hole 141, and a main exhaust stopper 142. Since the functions of the chip housing 110, the main channel microtube 120, and the negative pressure generation unit 130 are described above, repeated description will be omitted, and the functions of the main exhaust hole 141 and the main exhaust stopper 142 will be described.

The main exhaust hole 141 is formed on any one side of the main channel microtube 120 to move the internal air of the main channel microtube 120 and the external air of the chip housing 110 to each other.

The main exhaust stopper 142 opens the main exhaust hole 141 when the negative pressure generation unit 130 moves in a direction increasing the internal pressure of the main channel microtube 120, and closes the main exhaust hole 141 when the negative pressure generation unit 130 moves in a direction decreasing the internal pressure of the main channel microtube 120.

Meanwhile, the negative pressure generation unit 130 may have a bellows structure or an injector structure (syringe structure). The bellows according to an embodiment may have a wrinkled shape and mean a structure having flexibility in the longitudinal direction. For example, a part of an accordion, among musical instruments, that expands or shrinks, or a wrinkled part of a bent straw may be the bellows structure. The negative pressure generation unit 130 of a bellows structure according to an embodiment needs a process of expanding again after being pressed by an external force to generate a negative pressure as it does not have elasticity of the material itself, or may be expanded without a separate process, after being pressed by an external force, with the help of the material itself or an external elastic material.

FIG. 3 is a view showing an example of a negative pressure generator having a bellows structure.

According to the present specification, a method of using a microfluidic analysis chip having a negative pressure generation unit injects a sample into the sample inlet hole as shown in (a) of FIG. 3. Next is a step of generating a negative pressure inside the main channel microtube by handling the negative pressure generation unit 130. More specifically, as shown in (c) of FIG. 3, when the negative pressure generation unit 130 of a bellows structure is pressed, the internal pressure of the main channel microtube 120 is increased, and the main exhaust hole 141 is opened. Accordingly, the internal air of the main channel microtube 120 is exhausted to the outside. Thereafter, when the negative pressure generation unit 130 of a bellows structure is expanded as shown in (c) of FIG. 3, the main exhaust hole 141 is closed. Accordingly, a negative pressure is generated inside the main channel microtube 120, and the sample is moved.

Figure 4:
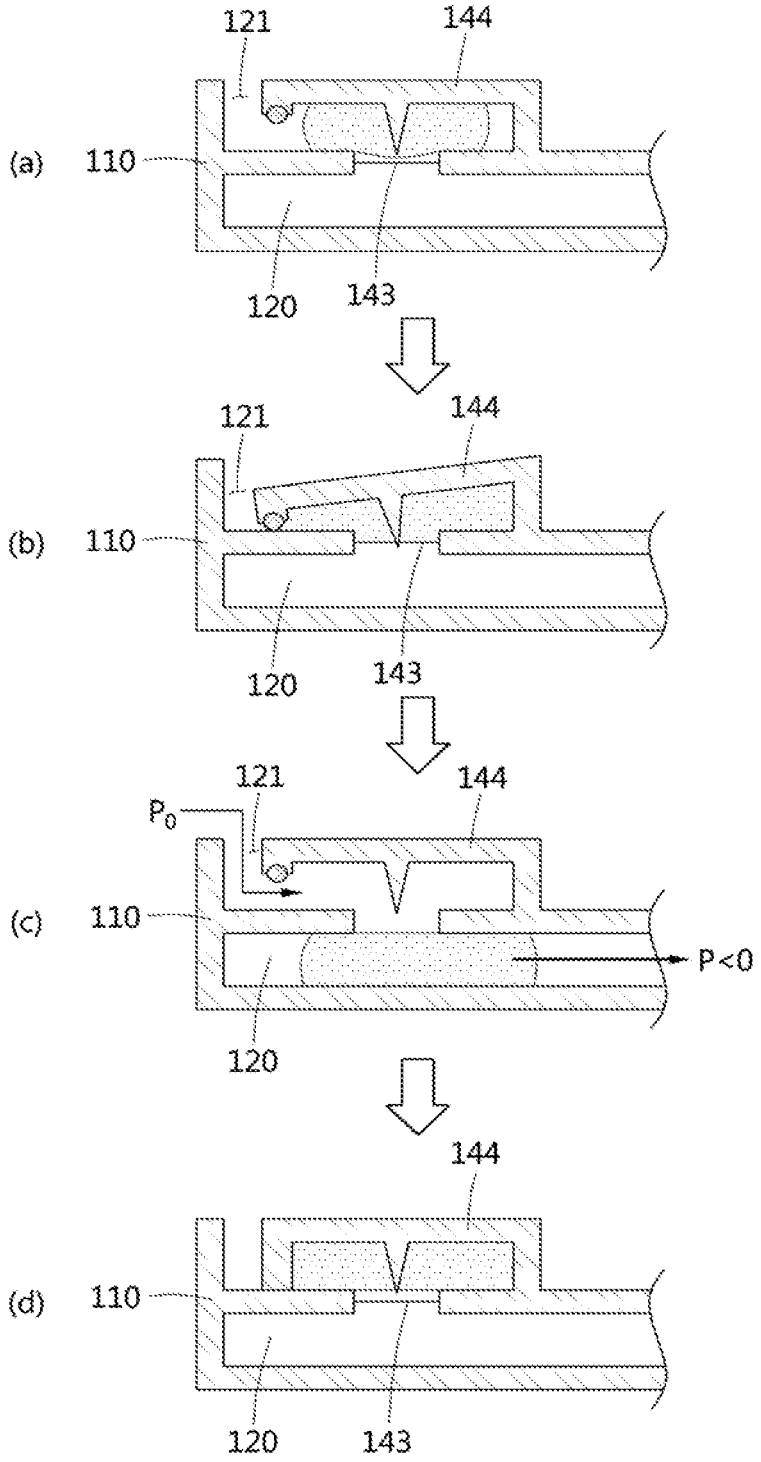
FIG. 4 is a partially enlarged cross-sectional view showing a sample inlet hole according to the present specification.

FIG. 4 is a partially enlarged cross-sectional view showing a sample inlet hole according to the present specification.

Referring to (a) of FIG. 4, the microfluidic analysis chip 100 according to the present specification may further include a sealing film 143 formed between the sample inlet hole 121 and the main channel microtube 120. The sealing film 143 may prevent foreign substances from flowing into the main channel microtube 120 in normal times. In addition, it may control the sample to flow into the main channel microtube 120 at a desired time after the sample is injected into the sample inlet hole 121.

According to the present specification, the microfluidic analysis chip 100 including the sealing film in the sample inlet hole 121 may further include a fine needle 144 that pierces the sealing film 143 by external pressure. Referring to (b) of FIG. 4, the fine needle 144 perform a function of piercing the sealing film so that the sample may flow into the main channel microtube 120.

Furthermore, the fine needle 144 may perform a function of sealing the sample inlet hole 121 by external pressure. Referring to (b) of FIG. 4, it may be confirmed that the sample inlet hole 121 is sealed after the fine needle 144 pierces the sealing film 143 by external pressure. To this end, the fine needle 144 may have a cover capable of sufficiently sealing the sample inlet hole 121, and a gasket for sealing may be formed at a portion where the cover and the sample inlet hole 121 contact with each other. Thereafter, as shown in (c) of FIG. 4, the fine needle 144 may be lifted upward to open again the sample inlet hole 121 so that external air may flow in.

Meanwhile, although (a), (b) and (c) of FIG. 4 show an example of sealing the sample inlet hole 121 after the fine needle 144 pierces the sealing film, as shown in (d) of FIG. 4, the size or height of the fine needle 144 may be sufficient as to seal the sample inlet hole 121 even before the sealing film is pierced.

Meanwhile, the sealing film 143 may be a photodegradable material. In this case, the microfluidic analysis chip 100 according to the present specification may further include an irradiation window (not shown) to allow light radiated from the outside of the chip housing 110 to reach the sealing film 143.

A method of using a microfluidic analysis chip including a sealing film will be described with reference to FIG. 4. First, a sample is injected into the sample inlet hole 121. Next, the sealing film is pierced. At this point, when the microfluidic analysis chip 100 includes a fine needle 144, the sealing film 143 may be pierced by applying a force to the fine needle 144. On the contrary, when the sealing film 143 is a photodegradation material and the microfluidic analysis chip 100 further includes an irradiation window, the sealing film 143 may be pierced by radiating light on the sealing film 143 through the irradiation window. Next, negative pressure is generated inside the main channel microtube 120 by handling the negative pressure generation unit 130. The sample will be moved by the negative pressure.

An example of moving the sample using the negative pressure generation unit in the microfluidic analysis chip 100 has been described above. However, it is also possible to expand the negative pressure generation unit to be used as a tool for moving a reagent, as well as moving the sample.

Figure 5:
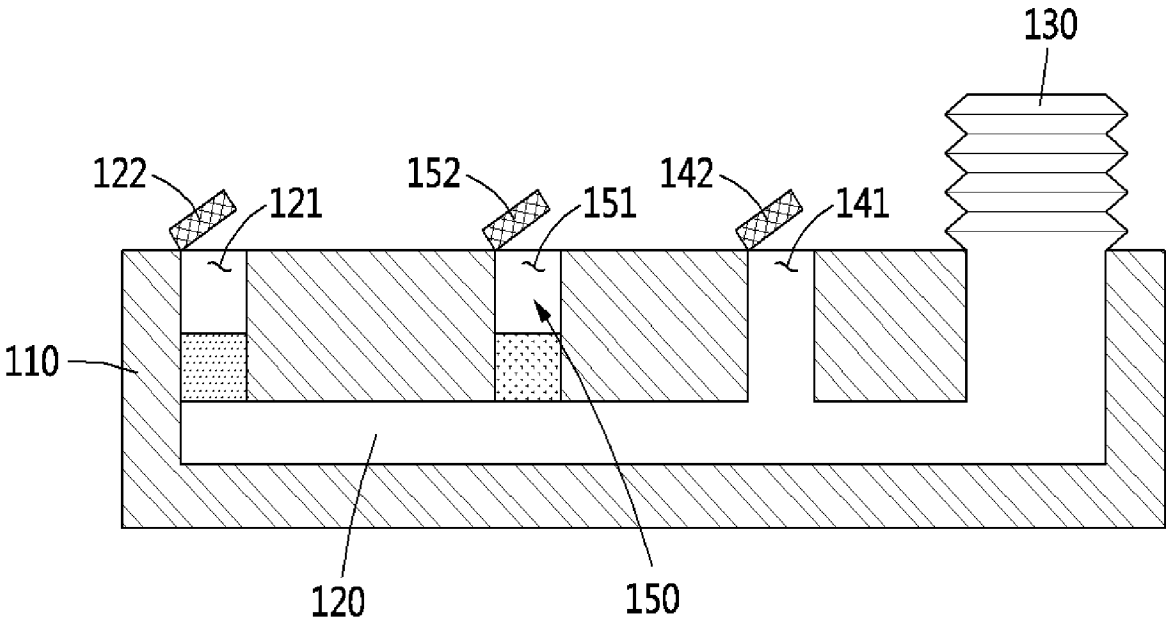
FIG. 5 is a view showing the configuration of a microfluidic analysis chip according to still another embodiment of the present specification.

FIG. 5 is a cross-sectional view showing the configuration of a microfluidic analysis chip according to still another embodiment of the present specification.

Referring to FIG. 5, the microfluidic analysis chip 100 according to another embodiment of the present specification may include a chip housing 110, a main channel microtube 120, a sample inlet stopper 122, a negative pressure generation unit 130, a main exhaust hole 141, a main exhaust stopper 142, a sub-channel microtube 150, a sub-exhaust hole 151 and a sub-exhaust stopper 152. Since the main channel microtube 120, the chip housing 110, and the negative pressure generation unit 130 are described above, repeated description will be omitted.

The sample inlet stopper 122 may open and close the sample inlet hole to arbitrarily control inflow of the external air of the chip housing 110.

The main exhaust hole 141 is connected to the main channel microtube 120 to move the internal air of the main channel microtube 120 and the external air of the chip housing 110 to each other.

The main exhaust stopper 142 may open and close the main exhaust hole to arbitrarily control inflow of the external air of the chip housing 110.

One end of the subchannel microtube 150 is connected to the side surface of the main channel microtube 120, and a reagent is injected therein. Although one subchannel microtube 150 is shown in FIG. 5, at least one or more subchannel microtubes 150 may be provided.

The sub-exhaust hole 151 is formed at the other end of the subchannel microtube 150 to move the internal air of the subchannel microtube 150 and the external air of the chip housing 110 to each other.

The sub-exhaust stopper 152 may open and close the sub-exhaust hole to arbitrarily control inflow of the external air of the chip housing 110.

The negative pressure generation unit 130 may have a bellows or injector structure. The negative pressure generation unit 130 may repeatedly generate negative pressure through the structure. The sample and the reagent may move more diversely using the characteristic that the negative pressure generation unit 130 may operate repetitively.

Hereinafter, a method of using a microfluidic analysis chip 100 according to still another embodiment of the present specification will be described.

Figure 6:
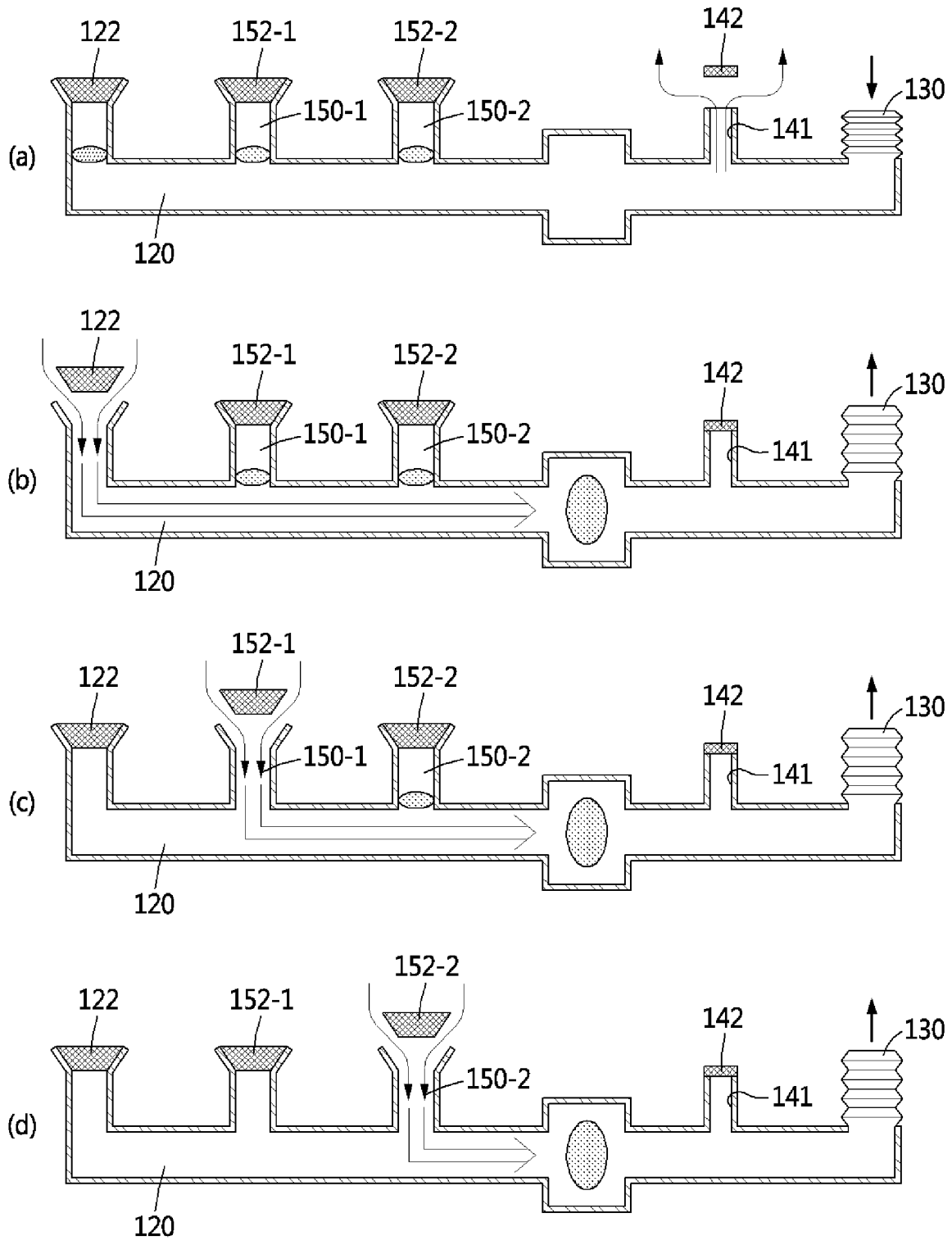
FIG. 6 is reference views showing a method of using a microfluidic analysis chip according to still another embodiment of the present specification.

FIG. 6 is reference views showing a method of using a microfluidic analysis chip according to still another embodiment of the present specification.

Referring to FIG. 6, two subchannel microtubes are shown unlike the embodiment of FIG. 5. In FIG. 6, for convenience of classification, the two subchannel microtubes will be referred to as a first subchannel microtube 150-1 and a second subchannel microtube 150-2, respectively. In addition, it is assumed that a first reagent is injected into the first subchannel microtube and a second reagent is injected into the second subchannel microtube.

A sample is injected into the sample inlet hole 121. Next, the sample inlet stopper 122, the main exhaust stopper 142 or the sub-exhaust stopper 152 is selectively opened and closed. Then, the sample or the reagent is moved by handling the negative pressure generation unit 130. In the embodiment shown in FIG. 6, an example of moving in order of the sample, the first reagent, and the second reagent is shown. Accordingly, selective opening and closing of the sample inlet stopper 122, the main exhaust stopper 142 or the sub-exhaust stopper 152 will be described in more detail.

First, as shown in (a) of FIG. 6, the main exhaust stopper 142 is opened, and the sample inlet stopper 122, the first sub-exhaust stopper 152-1 and the second sub-exhaust stopper 152-2 are closed. Then, the negative pressure generation unit 130 of a bellows structure is pressed to make a folded state (hereinafter, referred to as "a bellows initial state"). At this point, as the negative pressure generation unit 130 of a bellows structure is folded, the air pressure is exhausted through the main exhaust stopper 142.

Next, the sample inlet stopper 122 is opened, and the main exhaust stopper 142, the first sub-exhaust stopper 152-1 and the second sub-exhaust stopper 152-2 are closed as shown in (b) of FIG. 6 to move the sample. Then, the negative pressure generation unit 130 of a bellows structure is expanded to generate negative pressure inside the main channel microtube 120. At this point, since the sample inlet stopper 122 is in an open state, the sample is moved by the air pressure outside the chip housing 110.

For the bellows initial state, the main exhaust stopper 142 is opened, and the sample inlet stopper 122, the first sub-exhaust stopper 152-1, and the second sub-exhaust stopper 152-2 are closed. Then, the negative pressure generation unit 130 of a bellows structure is pressed to make a folded state ('return to the bellows initial state'). At this point, as the negative pressure generation unit 130 of a bellows structure is folded, the air pressure is exhausted through the main exhaust stopper 142.

Next, the first sub-exhaust stopper 152-1 is opened, and the main exhaust stopper 142, the sample inlet stopper 122 and the second sub-exhaust stopper 152-2 are closed as shown in (c) of FIG. 6 to move the first reagent. Then, the negative pressure generation unit 130 of a bellows structure is expanded to generate negative pressure inside the main channel microtube 120. At this point, since the first sub-exhaust stopper 152-1 is in an open state, the first reagent is moved by the air pressure outside the chip housing 110.

For the bellows initial state again, the main exhaust stopper 142 is opened, and the sample inlet stopper 122, the first sub-exhaust stopper 152-1, and the second sub-exhaust stopper 152-2 are closed. Then, the negative pressure generation unit 130 of a bellows structure is pressed to make a folded state ('return to the bellows initial state'). At this point, as the negative pressure generation unit 130 of a bellows structure is folded, the air pressure is exhausted through the main exhaust stopper 142.

Next, the second sub-exhaust stopper 152-2 is opened, and the main exhaust stopper 142, the sample inlet stopper 122 and the first sub-exhaust stopper 152-1 are closed as shown in (d) of FIG. 6 to move the second reagent. Then, the negative pressure generation unit 130 of a bellows structure is expanded to generate negative pressure inside the main channel microtube 120. At this point, since the second sub-exhaust stopper 152-2 is in an open state, the second reagent is moved by the air pressure outside the chip housing 110. Although an example of selectively moving the reagent or the sample is described through FIG. 6, the moving order and target are not limited by the present specification.

Although the embodiments of the present specification have been described with reference to the accompanying drawings, it can be understood that those skilled in the art may implement the present invention in other specific forms without changing the technical spirit or essential features. Therefore, it should be understood that the above-described embodiments are illustrative and not restrictive in all respects.

DESCRIPTION OF SYMBOLS

100: Microfluidic analysis chip
110: Chip housing
120: Main channel microtube
121: Sample inlet hole
122: Sample inlet stopper
130: Negative pressure generation unit
131: Pressed unit
132: Pushed unit
141: Main exhaust hole
142: Main exhaust stopper
143: Sealing film
150: Subchannel microtube
151: Sub-exhaust hole
152: Sub-exhaust stopper

The invention claimed is:

1. A microfluidic analysis chip comprising:

a main channel microtube for providing a space in which a sample injected from a sample inlet hole formed at one end reacts to a reagent while moving toward the other end;

a chip housing enclosing the main channel microtube; and a negative pressure generation unit located inside the chip housing and connected to affect internal pressure of the main channel microtube, wherein the negative pressure generation unit includes:

a pressed unit located on one of a top surface and a bottom surface of the main channel microtube; and a pushed unit located on the other one of the top surface and the bottom surface of the main channel microtube, wherein, when an external force is applied to the pressed unit, the pressed unit is configured to be pressed toward the inner space of the main channel microtube, the pushed unit is configured to be pushed together with the pressed unit toward the outside of the main channel microtube, shapes of the pressed unit and the pushed unit are transformed together, and an internal pressure of the main channel microtube is unchanged, and wherein, when a pressure to the pushed unit by the external force exceeds a critical point, a shape of the pushed unit is configured to be transformed and fixed toward the outside of the microtube to be symmetrical in a direction opposite to a pushing point by the external force.

2. The chip according to claim 1, wherein the pressed unit is made of a material that stores the external force as elastic energy when the pressed unit is pressed toward the inside of the main channel microtube by the external force.

3. A microfluidic analysis chip comprising:

a main channel microtube for providing a space in which a sample injected from a sample inlet hole formed at one end reacts to a reagent while moving toward the other end;

a chip housing enclosing the main channel microtube;

a negative pressure generation unit located inside the chip housing and connected to affect internal pressure of the main channel microtube;

a main exhaust hole formed on any one side of the main channel microtube to move internal air of the main channel microtube and external air of the chip housing to each other; and a main exhaust stopper for opening the main exhaust hole when the negative pressure generation unit moves in a direction increasing the internal pressure of the main channel microtube, and closing the main exhaust hole when the negative pressure generation unit moves in a direction decreasing the internal pressure of the main channel microtube.

4. The chip according to claim 3, wherein the negative pressure generation unit has a bellows structure.

5. A microfluidic analysis chip comprising:

a main channel microtube for providing a space in which a sample injected from a sample inlet hole formed at one end reacts to a reagent while moving toward the other end;

a chip housing enclosing the main channel microtube;

at least one or more subchannel microtubes, one end of which is connected to a side surface of the main channel microtube, into which a reagent is injected;

a negative pressure generation unit located inside the chip housing and connected to affect internal pressure of the main channel microtube;

a sample inlet stopper for opening and closing the sample inlet hole;

a sub-exhaust hole formed at one end of the subchannel microtube to move internal air of the subchannel microtube and external air of the chip housing to each other; and a sub-exhaust stopper for opening and closing the sub-exhaust hole.

6. The chip according to claim 5, wherein the negative pressure generation unit has a bellows structure.

7. A method of using a microfluidic analysis chip having a pushed unit and a pressed unit of an elastic material, the method comprising the steps of:

(a) injecting a sample into a sample inlet hole; and (b) pressing a pressure adjustment unit toward the inside of a main channel microtube, and pushing the pushed unit toward the outside of the main channel microtube together, by applying a force to the pressed unit, wherein, when an external force is applied to the pressed unit, the pressed unit is configured to be pressed toward the inner space of the main channel microtube, the pushed unit is configured to be pushed together with the pressed unit toward the outside of the main channel microtube, shapes of the pressed unit and the pushed unit are transformed together, and an internal pressure of the main channel microtube is unchanged, and wherein, when a pressure to the pushed unit by the external force exceeds a critical point, a shape of the pushed unit is configured to be transformed and fixed toward the outside of the microtube to be symmetrical in a direction opposite to a pushing point by the external force.

8. A method of using a microfluidic analysis chip having a pressed unit and a pushed unit, the method comprising the steps of:

(a) injecting a sample into a sample inlet hole;

(b) pressing the pressed unit toward the inside of a main channel microtube, and pushing the pushed unit toward the outside of the main channel microtube together, by applying a force to the pressed unit; and (c) restoring a shape in a direction of decreasing internal pressure of the main channel microtube by contacting the pressed unit, wherein, when an external force is applied to the pressed unit, the pressed unit is configured to be pressed toward the inner space of the main channel microtube, the pushed unit is configured to be pushed together with the pressed unit toward the outside of the main channel microtube, shapes of the pressed unit and the pushed unit are transformed together, and an internal pressure of the main channel microtube is unchanged, and wherein, when a pressure to the pushed unit by the external force exceeds a critical point, a shape of the pushed unit is configured to be transformed and fixed toward the outside of the microtube to be symmetrical in a direction opposite to a pushing point by the external force.

9. A method of using a microfluidic analysis chip having a sample inlet stopper, a main exhaust stopper, a sub-exhaust stopper, and a negative pressure generation unit, the method comprising the steps of:

(a) injecting a sample into a sample inlet hole;

(b) selectively opening and closing the sample inlet stopper, the main exhaust stopper or the sub-exhaust stopper; and (c) moving a sample or a reagent by handling the negative pressure generation unit.

* * * * *